US006405407B1

(12) United States Patent
Chen

(10) Patent No.: US 6,405,407 B1
(45) Date of Patent: Jun. 18, 2002

(54) LOCKING DEVICE FOR A TELESCOPIC HANDLE OF A LUGGAGE ITEM WITH WHEELS

(76) Inventor: Chien-Sen Chen, No. 505, Pu Tsu St., Fengyuan City, Taichung Hsien (TW)

( * ) Notice: Subject to any disclaimer, the term of this patent is extended or adjusted under 35 U.S.C. 154(b) by 75 days.

(21) Appl. No.: 09/666,635

(22) Filed: Sep. 21, 2000

(51) Int. Cl.[7] ..... B65D 25/28

(52) U.S. Cl. ..... 16/113.1; 280/47.371; 190/118

(58) Field of Search ..... 16/113.1, 405, 16/429; 190/39, 115, 118, 18 A, 18 R; 280/655, 655.1, 47.371, 47.17

(56) References Cited

U.S. PATENT DOCUMENTS 5,806,143 A * 9/1998 Tsai ..... 280/655.1
5,862,572 A * 1/1999 Lin et al. ..... 280/655
6,026,543 A * 2/2000 Chen ..... 16/113.1
6,141,828 A * 11/2000 Kuo ..... 16/113.1
6,332,241 B1 * 12/2001 Kuo ..... 16/113.1
6,338,586 B1 * 1/2002 Kuo ..... 16/113.1
6,338,587 B1 * 1/2002 Kuo ..... 16/113.1

* cited by examiner

*Primary Examiner*—Lynne H. Browne
*Assistant Examiner*—Doug Hutton
(74) *Attorney, Agent, or Firm*—Thorp Reed & Armstrong, LLP

(57) ABSTRACT

A locking device for a telescopic handle of a luggage item with wheels has a cap covering a bracket of a sliding strip. A block is received in the cap and has sloping edges abutting on sloping surfaces of the bracket. A finger is formed on the block and extends out an opening of an inner tuber and an aperture of an outer tube. The sliding strip is connected with a first end of a linkage and a lever is connected with a second end of the linkage. By pressing a button to turn the lever, the sliding strip is pulled upwards and the block will move inwards along the sloping surface of the bracket to retract the finger from the aperture of the outer tube for the adjustment of the inner tube.

9 Claims, 6 Drawing Sheets

LOCKING DEVICE FOR A TELESCOPIC HANDLE OF A LUGGAGE ITEM WITH WHEELS

BACKGROUND OF THE INVENTION

1. Field of the Invention

The present invention is related to a locking device, and more particularly to a locking device that is used to position telescopic handles of a luggage item.

2. Description of Related Art

A telescopic handle of a luggage item is shown in FIG. 6. The telescopic handle is composed of a pair of vertical bar assemblies each with an inner tube (81) retractably received in an outer tube (80) and a horizontal bar (83) to connect the vertical bar assemblies. A conventional locking device (90) for locating the inner tube (81) at a desired position in the outer tube (80) has a sliding block (91) with an arcuate surface (92) formed at a first side thereof. A flexible ring (93) is fixed in the inner tube (81) and pushed against the arcuate surface (92) of the sliding block (91) by a resilient member (96) provided therein and has a bowl portion (95) to engage with the arcuate surface (92). A finger (94) is formed on the flexible ring (93) and extends out an opening (811) of the inner tube (81) and an aligned one of a plurality of apertures (82) of the outer tube (80). A linkage (85) has a first end connected with the sliding block (91) and a second end connected with a lever (not numbered). The locking device is controlled by a button (84) provided in the horizontal bar (83) via the lever.

When the button (84) is pressed. the sliding block (91) is pulled upwards and the flexible ring (93) is compressed by the arcuate surface (92) to retract the finger (94) from the aperture (82) of the outer tube (80). Thus, a user can adjust the inner tube (81) to a desired position. Afterwards, the button (84) is released, and the finger (94) extends out another aperture (82) of the outer tube (80) at the desired position.

However, the conventional locking device has following shortcomings:

1. Because the engagement between the flexible ring (93) and the inner tube (81) is a "single-point", there is a great of chance for the flexible ring (93) to move unsteadily and the structure strength of the locking device is weak.

2. The flexible ring (93) made of plastic material will lose elastic flexibility after a long term use.

3. The linkage (85) is made by injection molding and the cost of manufacturing the linkage's mold is high.

Therefore, the invention provides a locking device for a telescopic handle to mitigate and/or obviate the aforementioned problems.

SUMMARY OF THE INVENTION

The main objective of the invention is to provide a locking device for a telescopic handle which has a stable structure.

Another objective of the invention is to provide a locking device for a telescopic handle which has a low manufacturing cost.

Another objective of the invention is to provide a locking device for a telescopic handle which can be assembled easily.

Other objects, advantages and novel features of the invention will become more apparent from the following detailed description when taken in conjunction with the accompanying drawings.

DETAILED DESCRIPTION OF THE PREFERRED EMBODIMENT

Figure 5:
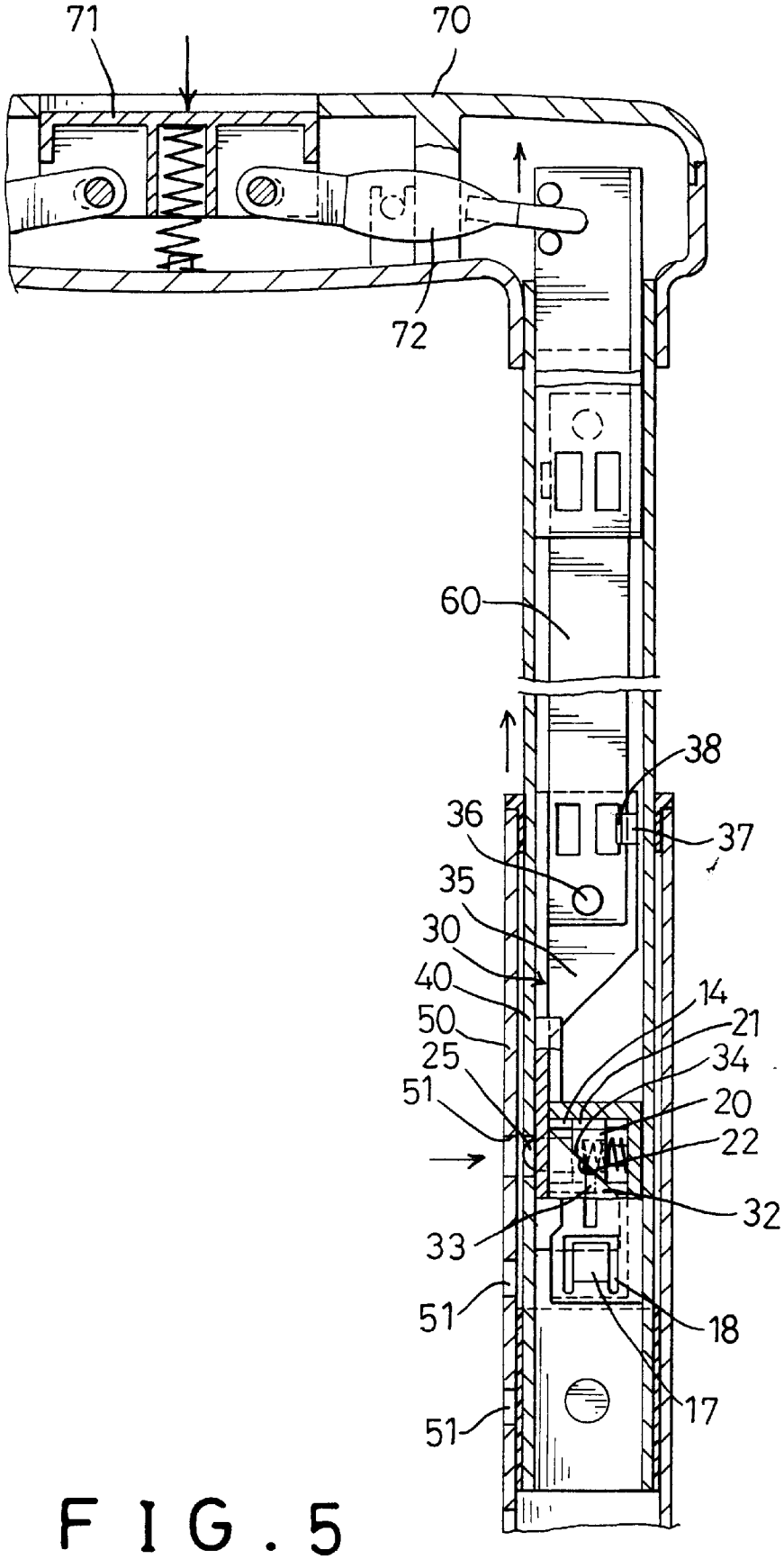
FIG. 5 is a cross sectional view showing the movement of the locking device when the button is pressed downwards.
Figure 6:
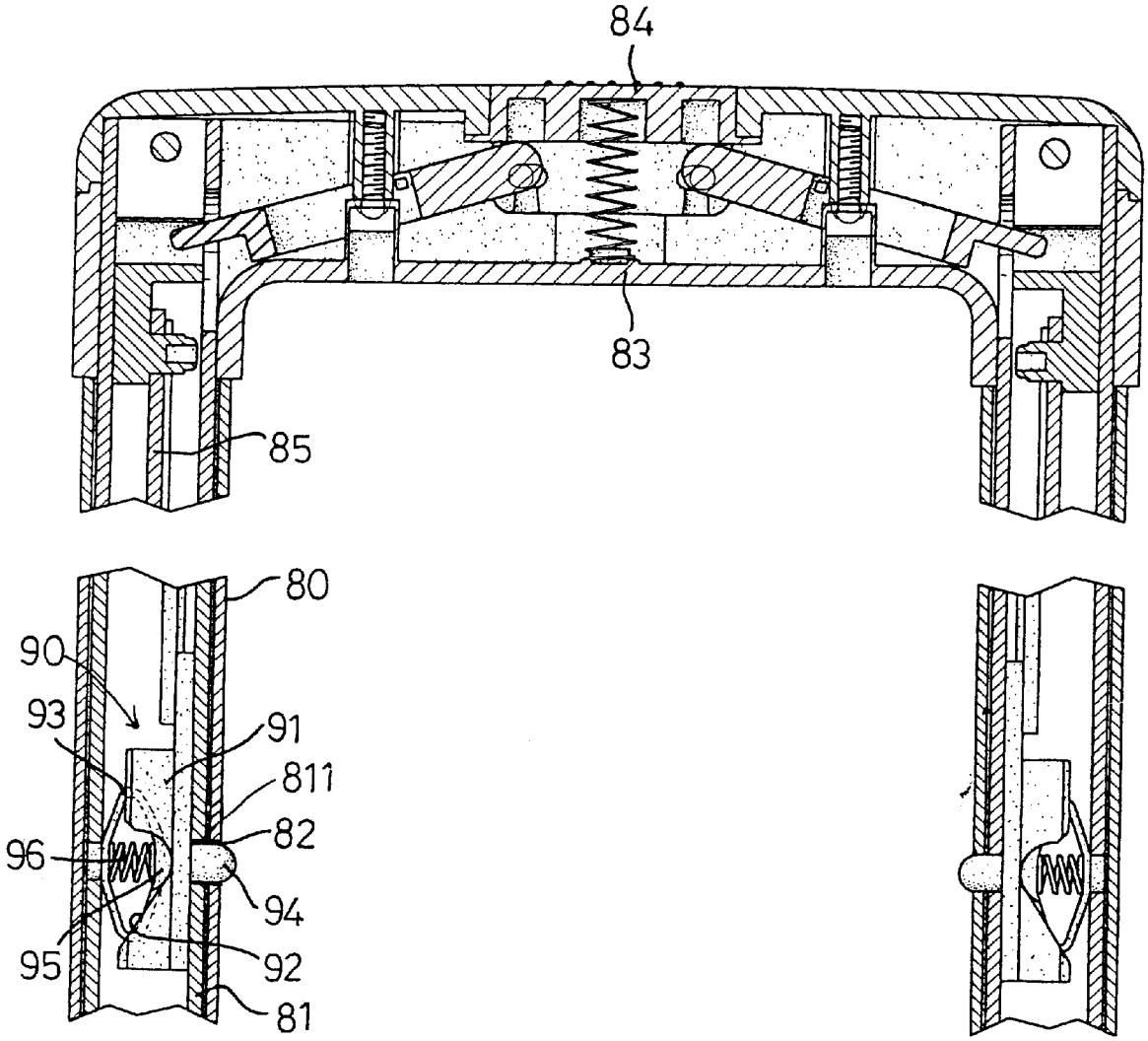
FIG. 6 PRIOR ART
FIG. 6 is a cross sectional view of a conventional telescopic handle.

Referring to the figures and FIG. 5 in particular, a telescopic handle generally is composed of a pair of telescopic tube assemblies including an inner tube (40) retractably received within an outer tube (50) and a horizontal bar (70) to connect the two telescopic tube assemblies. For the sake of simplicity and clarity of description, only one telescopic tube assembly at the right side is illustrated and described in detail. and it should be understood for those skilled in the art that the other at the left side is completely symmetrical with the right side.

Figure 1:
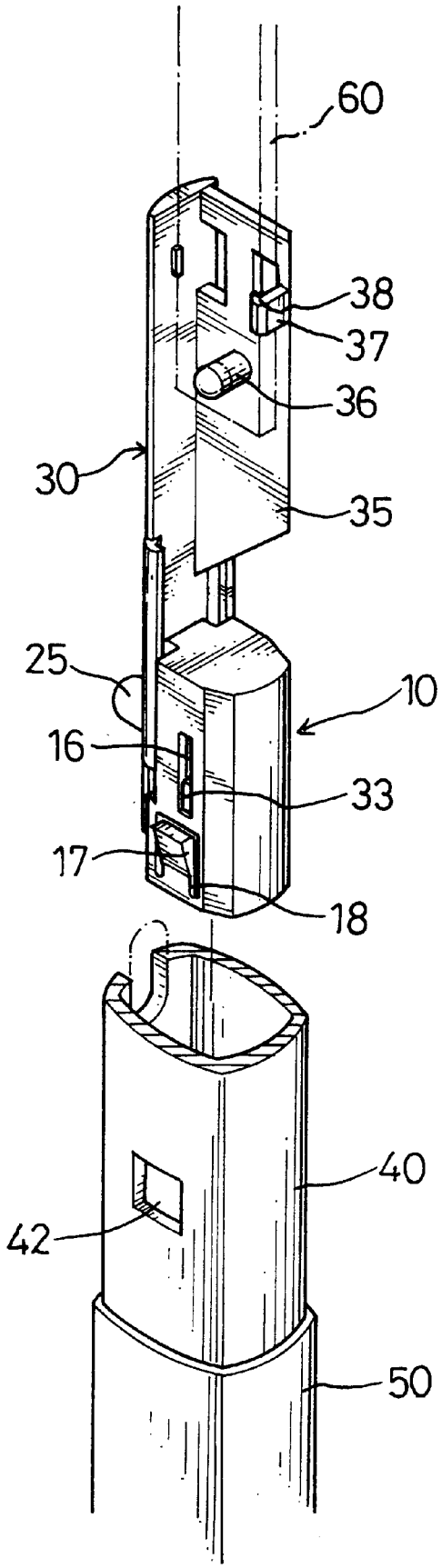
FIG. 1 is a perspective view of a locking device for a telescopic handle in accordance with the invention.
Figure 2:
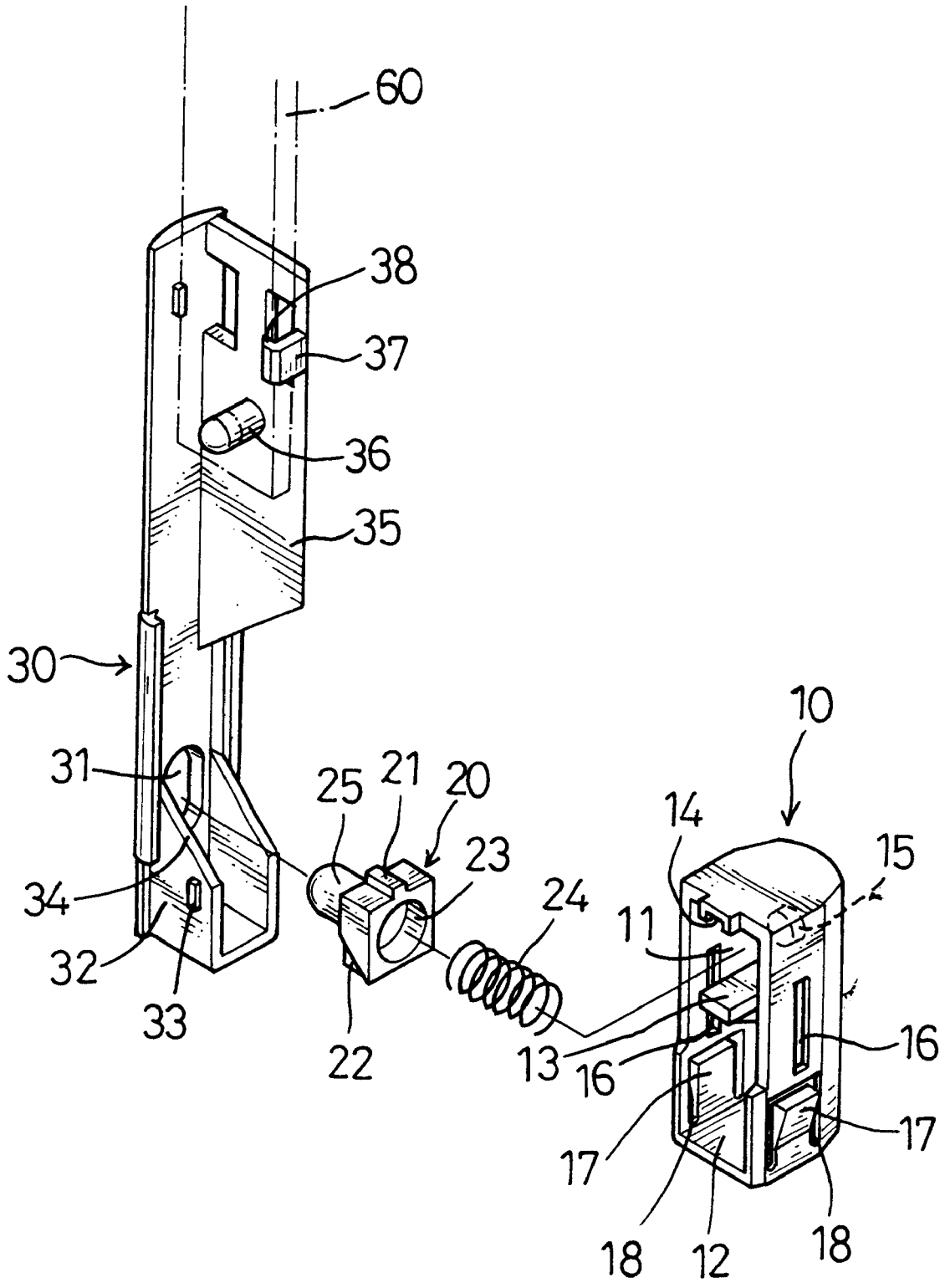
FIG. 2 is an exploded perspective view of the locking device in accordance with the invention.

Referring to FIGS. 1 and 2, a locking device in accordance with the present invention is provided in the inner tube (40) and is composed of a cap (10), a block (20), and a sliding strip (30).

Figure 3:
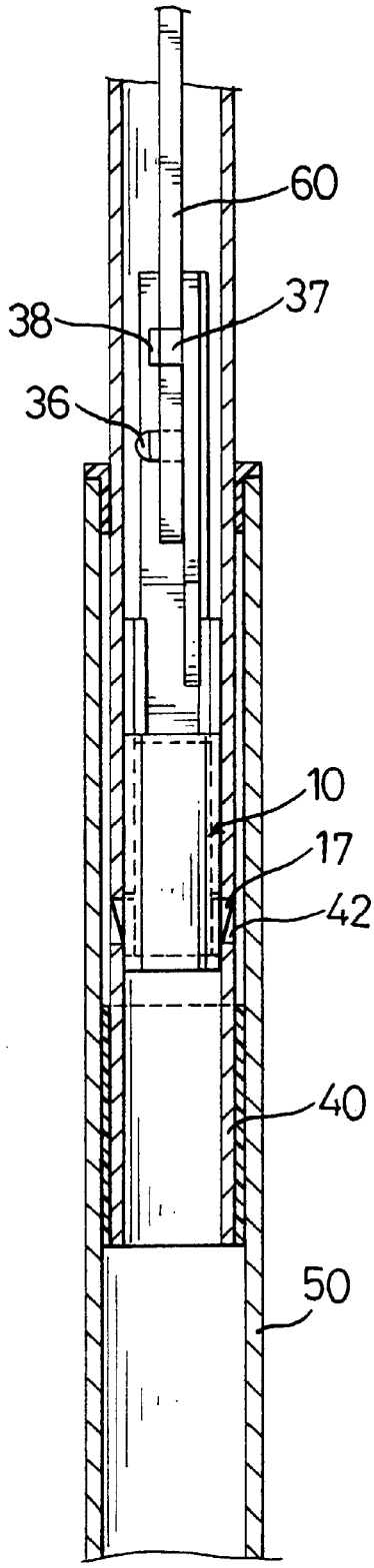
FIG. 3 is a side cross sectional view of the locking device assembled in an inner tube and an outer tube of a telescopic handle.
Figure 4:
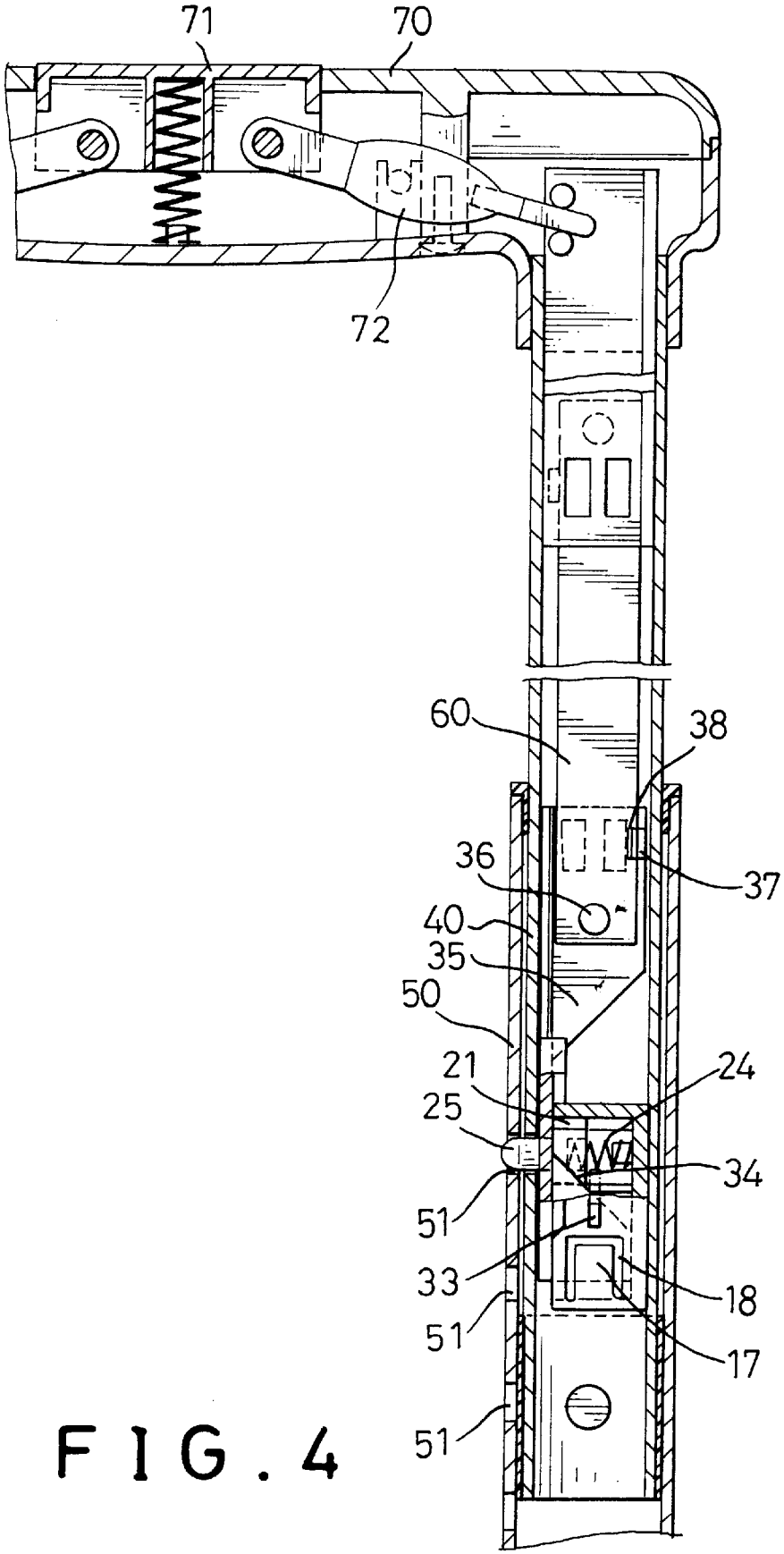
FIG. 4 is a cross sectional view showing the relationship between the locking device and a button and a lever of the telescopic handle.

Referring to FIGS. 2–4, the cap (10) which is formed by a pair of sidewalls, a bottom wall, an upper wall and a rear wall has an upper chamber (11) and a lower chamber (12) defined by a partition (13) transversally formed on the rear wall. A channel (14) is defined in the upper wall of the cap (10) and a protrusion (15) is formed on the rear wall in the upper chamber (11). Two elongated slots (16) are longitudinally defined through the sidewalls respectively and two flexible barbs (17) each with an inverted U-like groove (18) around the barb (17) are respectively formed below the elongated slots (16). Referring back to FIG. 1, the barbs (17) are respectively received in holes (42) defined through the inner tube (40) to fasten the cap (10) in the inner tube (40).

Referring back to FIGS. 2–4, the block (20) received in the upper chamber (14) of the cap (10) has a guide bar (21) formed on an upper surface thereof and received in the channel (14) to enable the block (20) to move along the channel (14). A recess (23) is defined in a rear surface of the block (20) and a resilient member (24) is provided between the block (20) and the rear wall of the cap (10) with a first end fixed in the recess (23) and a second end fixed on the protrusion (15). Two sloping edges (22) are respectively formed at two opposite bottom sides of the block (20). A finger (25) is formed on a front surface of the block (20).

The sliding strip (30) has a U-like bracket (32), which is composed of two opposite vertical plates and a horizontal plate, formed at a bottom portion thereof. Two ribs (33) are respectively longitudinally formed on outsides of the vertical plates of the bracket (32). The cap (10) covers the bracket (32) with the ribs (33) received within the elongated slots (16) respectively, and thus the cap (10) is movable upwards and downwards along the ribs (33). Two sloping surfaces

(34) are respectively formed at two opposite upper sides of the bracket (32) and the sloping edges (22) of the block (20) abut on the sloping surfaces (34) respectively. An elongated hole (31) is defined through the sliding strip (30) and between the two vertical plates of the bracket (32) for the finger (25) to extend therethrough. Especially referring to FIG. 4, the outer tube (50) has a plurality of apertures (51) longitudinally defined therethrough and the inner tube (40) has an opening (not numbered) aligned with the elongated hole (31). The finger (25) can extend through the opening of the inner tube (40) and one of the apertures (51) aligned with the opening to locate the inner-tube (40) at a desired position. Still referring to FIGS. 2–4, a junction plate (35) perpendicular to the sliding strip (30) is formed at an upper end of the sliding strip (30) and has a pin (36) formed thereon. A linkage (60) is mounted on the pin (36) with a first end thereof and connected with a lever (72) provided in the horizontal bar (70) with a second end thereof. The junction plate (35) further has a stop (37) formed at a side opposite the sliding strip (30) and a hook (38) formed at a free end of the stop (37). Thus, it is difficult for the linkage (60) to escape from the junction plate (35).

Referring to FIG. 5, when a user wants to adjust the telescopic handle, a button (71) provided in the horizontal bar (70) is pressed to turn the lever (72). The linkage (60) connected with the lever (72) is moved upwards and the sliding strip (30) is also moved upwards with the bracket (32). Because the cap (10) can move along the ribs (33) and will not follow the sliding strip (30), the block (20) in the cap (10) is moved inwards along the sloping surfaces (34) of the bracket (32) and the finger (25) is retracted from the aperture (51) of the outer tube (50). In this case, the user can adjust the inner tube (40) to align the opening with another aperture (51) at a desired position. Afterwards, the button (71) is released and the block (20) is pushed outwards by the resilient member (24) and the finger (25) extends out from the aperture (51) to locate the inner tube (40) at the desired position.

From the above description, it is noted that the invention has the following advantages:

1. Because the block has the guide bar received in the channel of the cap, the block is stably mounted in the upper chamber of the cap and will not swing in movement.

2. The cap has the barbs securing the inner tube, and compared with the conventional "single-point" contact, the locking device is mounted in the inner tube more stably.

3. The linkage can be formed from a plate by cutting without molds, so the manufacturing cost is low.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A locking device for a telescopic handle of a luggage item with wheels, the telescopic handle being composed of a pair of vertical bars each with an inner tube (40) retractably received in an outer tube (50), and a horizontal bar (70) connecting the vertical bars, the locking device provided in the inner tube (40) and comprising:

a cap (10) formed by a pair of sidewalls, a bottom wall, an upper wall and a rear wall, the cap (10) having an upper chamber (11) and a lower chamber (12) separated by a partition (13) transversally formed on the rear wall; two elongated slots (16) longitudinally defined through the sidewalls thereof respectively, and two flexible barbs (17) respectively formed below the elongated slots (16);

a block (20) movably received in the upper chamber (11), the block (20) having two sloping edges (22) formed at two opposite bottom sides thereof, a resilient member (24) provided between a rear surface of the block (20) and the rear wall of the upper chamber (11), and a finger (25) formed at a front surface thereof;

a sliding strip (30) having an elongated hole (31) defined therethrough for the finger (25) to be extendable therethrough, a U-like bracket (32) which is composed of two opposite vertical plates and a horizontal plate formed at a bottom end thereof and received in the cap (10), and two sloping surfaces formed at a top of the bracket (32) to match the sloping edges (22) of the block (20), two ribs (33) respectively formed at the outsides of the bracket (32) and received in the elongated slots (16) of the cap (10);

a junction plate (35) with a pin (36) formed at an upper end thereof; and a linkage (60) having a first end mounted on the pin (36) and a second end connected with a lever (72) provided in the horizontal bar (70).

2. The locking device as claimed in claim 1, wherein the cap (10) further comprises a groove (18) defined around each of the barbs (17).

3. The locking device as claimed in claim 2, wherein the groove (18) is U-shaped.

4. The locking device as claimed in claim 1, wherein the cap (10) further comprises a channel (14) defined at an inside of the upper wall, and the block (20) further comprises a guide bar (21) formed at an upper surface thereof for receiving in the channel (14).

5. The locking device as claimed in claim 1, wherein the cap (10) further comprises a protrusion (15) formed on the rear wall in the upper chamber (11), and the resilient member (24) is fixed on the protrusion (15) with a first end.

6. The locking device as claimed in claim 1, wherein the block (20) further comprises a recess (23) defined at a rear surface thereof, and the resilient member (24) is fixed in the recess (23) with a second end.

7. The locking device as claimed in claim 1, wherein the cap (10) further comprises a protrusion (15) formed on the rear wall in the upper chamber (11), the block (20) further comprises a recess (23) defined at a rear surface thereof, and the resilient member (24) is fixed on the protrusion (15) with a first end and in the recess (23) with a second end.

8. The locking device as claimed in claim 1, wherein the junction plate (35) further comprises a stop (37) formed at a side opposite the sliding strip (30).

9. The locking device as claimed in claim 8, wherein the stop (37) has a hook (38) formed at a free end thereof.

* * * * *